United States Patent [19]

Ikeda et al.

[11] Patent Number: 4,855,279

[45] Date of Patent: Aug. 8, 1989

[54] HEAT-SENSITIVE RECORDING MATERIAL

[75] Inventors: Haruhiko Ikeda; Akinori Okada; Hirokazu Ohkura, all of Tokyo, Japan

[73] Assignee: Mitsubishi Paper Mills, Limited, Tokyo, Japan

[21] Appl. No.: 268,941

[22] Filed: Nov. 8, 1988

[30] Foreign Application Priority Data

Nov. 9, 1987 [JP] Japan ..... 62-283749

[51] Int. Cl.[4] ..... B41M 5/18

[52] U.S. Cl. ..... 503/209; 427/150; 427/151; 428/913; 503/208; 503/225

[58] Field of Search ..... 427/150–152; 428/913; 503/208, 209, 225

[56] References Cited

U.S. PATENT DOCUMENTS

| | | | |
|---|---|---|---|
| 4,644,375 | 2/1987 | Satake et al. | 503/209 |
| 4,688,058 | 8/1987 | Ikeda et al. | 503/208 |

FOREIGN PATENT DOCUMENTS

| | | | |
|---|---|---|---|
| 18-4160 | 2/1943 | Japan | 503/209 |
| 45-14039 | 5/1970 | Japan | 503/209 |
| 46-19231 | 3/1973 | Japan | 503/209 |
| 49-34842 | 3/1974 | Japan | 503/209 |
| 50-149353 | 11/1975 | Japan | 503/209 |
| 52-106746 | 9/1977 | Japan | 503/209 |
| 53-5636 | 1/1978 | Japan | 503/209 |
| 57-64592 | 4/1982 | Japan | 503/209 |
| 57-64593 | 4/1982 | Japan | 503/209 |
| 57-185187 | 11/1982 | Japan | 503/209 |
| 57-191089 | 11/1982 | Japan | 503/209 |
| 58-87094 | 5/1983 | Japan | 503/209 |
| 58-110289 | 6/1983 | Japan | 503/209 |
| 60-56588 | 4/1985 | Japan | 503/209 |
| 60-122193 | 6/1985 | Japan | 503/209 |
| 61-242884 | 10/1986 | Japan | 503/209 |
| 61-272189 | 12/1986 | Japan | 503/209 |

*Primary Examiner*—Bruce H. Hess

*Attorney, Agent, or Firm*—Cushman, Darby & Cushman

[57] ABSTRACT

A heat-sensitive recording material containing a special sensitizer in a heat-sensitive recording layer is excellent in thermal response properties and sensitivity.

6 Claims, No Drawings

HEAT-SENSITIVE RECORDING MATERIAL

BACKGROUND OF THE INVENTION

This invention relates to a highly sensitive heat-sensitive recording material excellent in thermal response.

A heat-sensitive recording material generally comprises a support and formed thereon a heat-sensitive recording layer composed mainly of an electron donative, colorless or light-colored dye precursor and an electron-accepting color developer. Upon heating with a thermal head, a thermal pen, a laser light or the like, the dye precursor instantaneously reacts with the color developer to give recording images. Such a system is disclosed, for example, in Japanese Patent Examined Publication Nos. 43-4160 and 45-14039. Such heat-sensitive recording materials have been used over a wide range of fields such as measuring recorders, facsimile machines, printers, terminals of computers, labels, automatic ticket vending machines, etc., because the recording can easily be made using a relatively simple device, the maintenance is easy, noises are not produced, and the like. Particularly in facsimile machines, a great demand for heat-sensitive type continues to expand and at the same time, the speed of the machine is getting faster and faster because of necessity for reducing the transmission cost. In response to such a high speed facsimile, the demand for higher sensitive heat-sensitive recording materials is increasing.

In order to transmit and receive a standard original of A-4 size in several to 20 seconds in high speed facsimile machines, it is necessary to repeatedly apply a current to the thermal head in such a very short period of time as several milliseconds or less, and the heat energy generated thereby is transmitted to heat-sensitive recording sheet in which the reaction for forming images is carried out.

In order to carry out the reaction for forming images by the heat energy transmitted in such a short period of time, it is required that the heat-sensitive recording material is excellent in thermal response. To enhance the thermal response or reactivity, compatibility of a color developer with a dye precursor should be improved. For this purpose, sensitizers are used depending on necessity. The sensitizers have an action to accelerate the color-forming reaction by dissolving or enveloping therein dye precursors and color developers present around them when the sensitizers themselves melt with the transferred heat energy. For increasing the sensitivity of the heat-sensitive recording material, it is one method to improve the thermal response of the sensitizers or compatibility of the sensitizers with the dye precursors or color developers.

As such a technique, there are disclosed methods for adding waxes in Japanese Patent Unexamined Publication No. 48-19231; for adding nitrogen-containing compounds, carboxylic acid esters, etc., in Japanese Patent Unexamined Publication Nos. 49-34842, 50-149353, 52-106746, and 53-5636; for adding naphthol derivatives in Japanese Patent Unexamined Publication Nos. 57-64593 and 58-87094; for adding naphthoic acid derivatives in Japanese Patent Unexamined Publication Nos. 57-64592, 57-185187, 57-191089 and 58-110289; for adding p-benzyl-biphenyl in Japanese Patent Unexamined Publication No. 60-122193; for adding 4-allyloxybiphenyl in Japanese Patent Unexamined Publication No. 61-272189; for adding a diphenyloxyethane in Japanese Patent Unexamined Publication No. 60-56588; and for adding a sulfide in Japanese Patent Unexamined Publication No. 61-242884.

However, the heat-sensitive recording materials produced by these methods are still insufficient in developed color density and color development sensitivity.

SUMMARY OF THE INVENTION

It is an object of this inventionn to provide a heat-sensitive recording material excellent in thermal response and sensitivity.

This invention provides a heat-sensitive recording material comprising a support and formed on the support a heat-sensitive recording layer comprising a colorless or light-colored dye precursor, a color developer capable of developing a color of said dye precursor with heating, and a sensitizer, characterized in that said sensitizer is a compound of the formula:

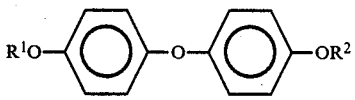

(I)

wherein $R^1$ is a lower alkyl group, a lower alkenyl group or an acyl group; and $R^2$ is an aralkyl group or an aroyl group.

DESCRIPTION OF THE PREFERRED EMBODIMENTS

The sensitizer used in this invention is a compound represented by the formula:

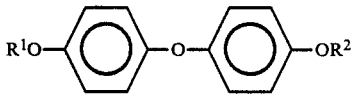

(I)

wherein $R^1$ is a lower alkyl group preferably having 1 to 4 carbon atoms, a lower alkenyl group preferably having 2 to 4 carbon atoms, or an acyl group preferably having 1 to 4 carbon atoms; and $R^2$ is an aralkyl group preferably having 7 to 11 carbon atoms, or an aroyl group preferably having 7 to 11 carbon atoms.

The term "lower alkyl group" includes, for example, methyl, ethyl, propyl, butyl, isopropyl, ethoxyethyl, vinyloxyethyl, etc. The term "lower alkenyl group" includes, for example, allyl, vinyl, methallyl, 2-chloroallyl, 2-butenyl, etc. The term "acyl group" includes, for example, acetyl, formyl, propionyl, butylyl, isobutylyl, etc. The term "aralkyl group" includes, for example, benzyl, m-methylbenzyl, p-methylbenzyl, p-chlorobenzyl, p-anisyl, α-methylbenzyl, β-phenetyl, p-isopropylbenzyl, α-naphthylmethyl, etc. The term "aroyl group" includes, for example, benzoyl, p-toluyl, p-methoxybenzoyl, p-chlorobenzoyl, α-naphthylcarbonyl, β-naphthylcarbonyl, etc.

Preferable examples of the compound of the formula (I) are as follows:

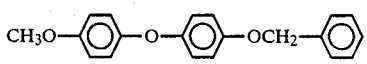

(II)

m.p. = 106.5 to 108.5° C.

-continued (III)

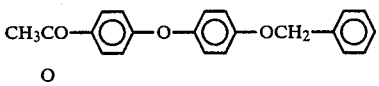

m.p. = 111.5 to 113.0° C.

(IV)

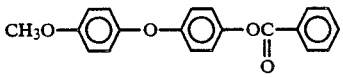

m.p. = 90.5 to 92.0° C.

(V)

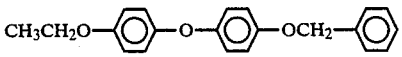

m.p. = 102.5 to 104.0° C.

(VI)

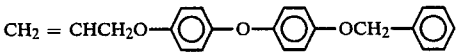

m.p. = 94.5 to 97.0° C.

(VII)

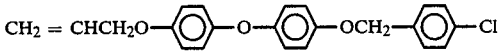

m.p. = 109.0 to 111.5° C.

(VIII)

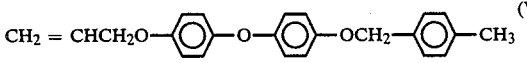

m.p. = 103.0 to 105.0° C.

(IX)

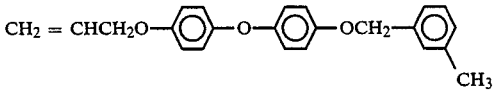

m.p. = 86.0 to 89.0° C.

(X)

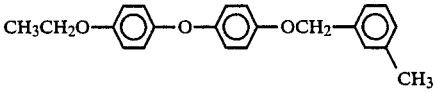

m.p. = 88.0 to 90.5° C.

These compounds can be prepared by a conventional process.

The sensitizer is used in an amount of 5% by weight or more, preferably 10 to 400% by weight, more preferably 20 to 300% by weight based on the weight of the color developer. When the amount is less than 5% by weight, the improvement of the sensitivity is insufficient, while when the amount is more than 400% by weight, there sometimes takes place an economical disadvantage and a sufficient color developing density cannot be obtained due to a dilution effect caused by the use of a larger amount of hot meltable substance.

As the dye precursor, there can be used conventional ones such as triphenylmethanes, fluorans, diphenylmethanes, thiazines, spiropyranes, etc. Examples of the dye precursors are 3,3-bis(p-dimethylamino-phenyl)-6-dimethylaminophthalide, 3-(4-diethylamino-2-ethoxyphenyl)-3-(1-ethyl-2-methylindol-3-yl)-4-azaphthalide, 3-diethylamino-6-methyl-7-chlorofluoran, 3-diethylamino-7-chlorofluoran, 3-(N-cyclohexylamino)-7-methylfluoran, 3-diethylamino-7-methylfluoran, 3-diethyl-amino-6-chloro-7-methylfluoran, 3-diethylamino-7-anilinofluoran, 3-diethylamino-6-methyl-7-dibenzylamino-fluoran, 3-(N-ethyl-N-p-toluidino)-7-anilinofluoran, 3-diethylamino-7-(o-chloroanilino)fluoran, 3-dibutylamino07-(o-chloroanilino)fluoran, 3-diethylamino-6-methyl-7-anilinofluoran, 3-(N-ethyl-N-p-toluidino)-6-methyl-7-anilinofluoran, 3-(N-methyl-N-cyclohexylamino)-6-methyl-7-anilinofluoran, 3-piperidino-6-methyl-7-anilinofluoran, 3-pyrrolidino-6-methyl-7-anilinofluoran, 3-diethylamino-7-(m-trifluoromethylanilino)fluoran, 3-(N-ethyl-N-isopentylamino)-6-methyl-7-anilinofluoran, 3-diethylamino-6-methyl-7-(p-phenetidino)fluoran, 3-dibutylamino-7-(o-fluoroanilino)fluoran, 3-dibutylamino-6-methyl-7-anilinofluoran, etc.

As the color developer, there can be used acidic substances conventionally used for heat-sensitive paper, namely, electron-accepting compounds such as phenol derivatives, aromatic carboxylic acid derivatives, N,N'-diarylthiourea derivatives, polyvalent mettalic compounds, e.g. zinc compounds, etc.

Preferable examples of the color developer are bisphenols of the formula:

(XI)

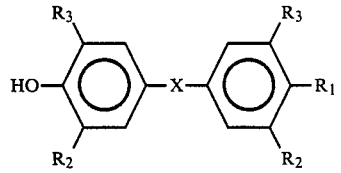

wherein X is

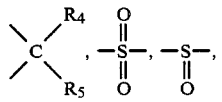

—S— or —O—; $R_1$ is a hydroxyl group, a lower alkoxy group preferably having 1 to 4 carbon atoms, a lower alkyl group preferably having 1 to 4 carbon atoms, a halogen atom such as chlorine, bromide, iodine or fluorine, or a hydrogen atom; $R_2$ and $R_3$ are independently a hydrogen atom, a lower alkyl group preferably having 1 to 4 carbon atoms, a lower alkenyl group preferably having 1 to 4 carbon atoms or a halogen atom; $R_4$ and $R_5$ are independently a hydrogen atom, a lower alkyl group preferably having 1 to 4 carbon atoms or a lower alkoxycarbonyl group preferably having 2 to 6 carbon atoms, and $Rx_4$ and $R_5$ may be bonded to form a ring.

Concrete examples of the formula (XI) are as follows:
2,2-bis(4-hydroxyphenyl)propane,
2,2-bis(4-hydroxyphenyl)butane,
1,1-bis(4-hydroxyphenyl)cyclohexane,
2,2-bis(4-hydroxyphenyl)pentane,
2,2-bis(4-hydroxyphenyl)hexane,
methyl 2,2-bis(4-hydroxyphenyl)acetate,
ethyl 2,2-bis(4-hydroxyphenyl)acetate,
butyl 2,2-bis(4-hydroxyphenyl)acetate,
bis(4-hydroxyphenyl)sulfone,
bis(4-hydroxyphenyl)sulfoxide,
4,4'-dihydroxydiphenyl ether,
bis(4-hydroxyphenyl)sulfide,
4-hydroxy-4'-isopropyloxydiphenylsulfone,
4-hydroxy-4'-methyldiphenylsulfone,
4-hydroxy-4'-chlorodiphenylsulfone,
2,2-bis(3-t-butyl-4-hydroxyphenyl)propane,
2,2-bis(3-chloro-4-hydroxyphenyl)propane,
bis(3-allyl-4-hydroxyphenyl)sulfone,
bis(3-t-butyl-4-hydroxy-5-methylphenyl)sulfide,
4-hydroxydiphenylsulfone, etc.

Other preferable examples of the color developers are as follows:
benzyl 4-hydroxybenzoate,
1,7-bis(4-hydroxyphenylthio)-3,5-dioxaheptane, N,N'-bis(3-chlorophenyl)thiourea,
zinc thiocyanate,
N,N'-bis(3-trifluoromethylphenyl)thiourea,
lauryl gallate,
stearyl gallate,
behenyl gallate,
zinc hydroxynaphthoate,
zinc oxide,
salicylic anilide,
dimethyl 4-hydroxyphthalate,
metal (e.g. Zn) salt of 5-t-butyl salicylate,
dimethyl 6-hydroxy-2,3-naphthalenedicarboxylate,
methyl 4-hydroxybenzoate,
4-hydroxybenzoic acid,
benzyl 2,4-dihydroxybenzoate,
benzyl 3,4-dihydroxybenzoate,
4-t-butyl benzoate,
5-chlorosalicylanilide,
isopropyl 4-hydroxybenzoate,
2-phenoxyethyl 4-hydroxybenzoate,
benzoic acid,
novolak-type phenol resin,
2,2'-dihydroxybiphenyl,
1-naphthol,
2-naphthol,
bis(2-hydroxy-5-chlorophenyl)methane,
1,1-bis(2-hydroxy-5-methylphenyl)dodecane,
4-phenylphenol,
4-t-butylphenol,
phenol,

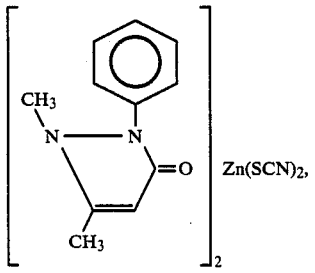

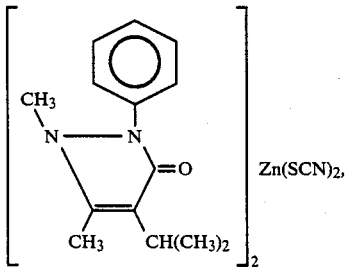

1,5-bis(3-hydroxyphenoxy)pentane,
1,2-bis(3-hydroxyphenoxy)ethane,
1,2-bis(4-hydroxyphenoxy)ethane,
1-(2,4-dihydroxyphenyl)-1-phenylethane,
stearyl 4-hydroxybenzoate,
3,4-dihydroxy-4'-methyldiphenyl sulfone,
1,5-bis(4-hydroxyphenylthio)-3-oxapentane
1,1-bis(4-hydroxyphenyl)-1-phenylethane,

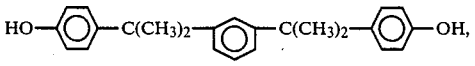

3-(2-phenoxyethoxy)phenol,
p-hydroxyacetophenone,
4,4'-isopropylidenebis(2-chlorophenol), etc.

The heat-sensitive recording layer may further contain one or more binders, pigments, head wear preventing agents, sticking preventing agents, dispersing agents, ultraviolet absorbers, surface active agents, fluorescent dyes, etc.

Examples of the binders are water-soluble binders such as starches, hydroxyethyl cellulose, methyl cellulose, carboxymethyl cellulose, gelatin, casein, polyvinyl alcohol, modified polyvinyl alcohol, styrenemaleic anhydride copolymers, ethylene-maleic anhydride copolymers, etc.; latex type water-soluble binders such as styrene-butadiene copolymers, acrylonitrile-butadiene copolymers, methyl acrylate-butadiene copolymers, etc.

Examples of the pigments are diatomaceous earth, talc, kaolin, calcined kaolin, calcium carbonate, magnesium carbonate, titanium oxide, zinc oxide, silicon oxide, aluminum hydroxide, urea-formaldehyde resin, etc.

Examples of the head wear preventing agents and the sticking preventing agents are higher fatty acid metal salts such as zinc stearate, calcium stearate, etc.; paraffin, oxidized paraffin, polyethylene, oxidized polyethylene, stearic acid amide, waxes such as castor wax, etc.

Examples of the dispersing agents are sodium dioctylsulfosaccinate, etc.

Examples of the ultraviolet absorbers are benzophenone series compounds, benzotriazole series compounds, etc.

As the support there can be used paper, various kinds of unwoven fabrics, plastic films, synthetic paper, metal foils, composite sheets obtained by combining these materials, etc.

The support may have an undercoating layer thereon. The undercoating layer contains mainly pigments such as calcium carbonate, kaolin, calcined kaolin, and the like. The undercoating layer seems to have an effect for making the outmost surface smoother by improving unevenness of the support, which results in making the contact with a thermal head better so as to act thermal energy effectively on the heat-sensitive layer.

This invention is illustrated in detail by way of the following Examples, in which all percents are by weight unless otherwise specified.

SYNTHESIS EXAMPLE 1

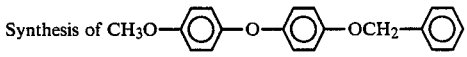

(II)

(1) Synthesis of 4-hydroxy-4'-benzyloxydiphenyl ether

To 100 ml of water, 10.1 g of 4,4'-dihydroxy-diphenyl ether and 2.1 g of sodium hydroxide were added, and then 10.3 g of benzyl bromide was added dropwise, followed by stirring for additional 6 hours. Subsequently, ethyl acetate was added to the system, which was then separated into an aqueous layer and an organic layer. The organic layer was washed with an aqueous solution of sodium bicarbonate, dried over anhydrous sodium sulfate and distilled to removed the solvent. The residue was recrystallized from a mixed solvent of water and methanol repeatedly to give 4-hydroxy-4'-benzyloxydiphenyl ether having a melting point of 115.2° to 116.5° C.

(2) Synthesis of 4-methoxy-4'-benzyloxydiphenyl ether

To 100 ml of acetone, 9.50 g of 4-hydroxy-4'-benzyloxydiphenyl ether and 8.2 g of a 21% sodium hydroxide aqueous solution were added. To this system, 4.58 g of dimethyl sulfate was added dropwise with stirring. After stirring for 4 hours, the resulting reaction mixture was subjected to separation by adding thereto toluene and water. The organic layer separated was washed with aqueous solution of sodium bicarbonate, dried over sodium sulfate, and distilled to remove the solvent. The residue was recrystallized from methanol to give 7.9 g of the desired compound of the formula (II) having a melting point of 106.5° to 108.5° C.

SYNTHESIS EXAMPLE 2

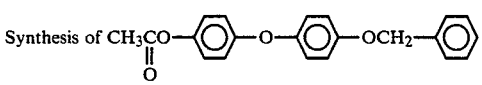

(III)

To 100 ml of acetone, 9.50 g of 4-hydroxy-4'-benzyloxyphenyl ether and 7.0 g of a 29.1% sodium hdyroxide aqueous solution were added. To this system, 4.0 g of acetic anhydride was added dropwise with stirring. After stirring for additional 5 hours, toluene and water were added to the system, which was then separated into an aqueous layer and an organic layer. The organic layer was washed with an aqueous solution of sodium bicarbonate, dried over anhydrous sodium sulfate, and distilled to remove the solvent. The residue was treated with ethanol, followed by recrystallization from ethanol to give 8.1 g of the desired compound of the formula (III) having a melting point of 111.5° to 113.0° C.

SYNTHESIS EXAMPLE 3

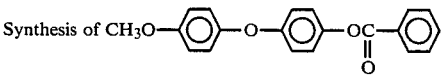

(IV)

To 70 ml of acetone, 7.57 g of 4-hydroxy-4'-methoxydiphenyl ether and 7.0 g of a 30.9% sodium hydroxide solution were added. To this system, 5.90 g of benzoyl chloride was added dropwise with stirring. After additional stirring for 5 hours, toluene and water were added to the system for the separation. The separated organic layer was washed with an aqueous solution of sodium bicarbonate, dried over anhydrous sodium sulfate, and distilled to remove the solvent. The residue was treated with ethanol, followed by recrystallization from ethanol to give 9.1 g of the desired compound of the formula (IV) having a melting point of 90.5° to 92.0° C.

SYNTHESIS EXAMPLE 4

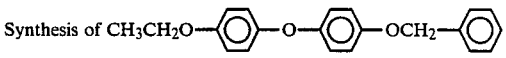

(V)

To 150 ml of acetone, 4.75 g of 4-hydroxy-4'-benzyloxydiphenyl ether and 6.4 g of a 10% sodium hydroxide aqueous solution were added. To this system, 7.8 g of ethyl iodide was added with stirring. Then, the system was subjected to reflux with heating for 6 hours. After cooling, ethyl acetate and water were added to the system, followed by separation. The separated organic layer was washed with water, dried over anhydrous potassium carbonate and distilled to remove the solvent. The residue was treated with ethanol, followed by recrystallization to give 3.29 g of the desired compound of the formula (V) having a melting point of 104.5° to 105.5° C.

SYNTHESIS EXAMPLE 5

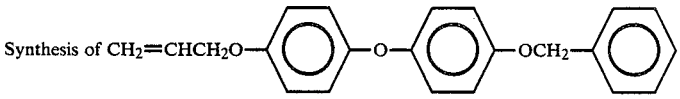

(VI)

To 200 ml of acetone, 9 g of 4-hydroxy-4'-benzyloxydiphenyl ether and 0.5 g of a 30% sodium hydroxide aqueous solution were added, followed by addition of 4.84 g of allyl bromide. This system was subjected to reflux conditions with heating for 8 hours with stirring. Then, ethyl acetate and water were added to the system and separated. The separated organic layer was washed with water, dried over anhydrous sodium sulfate, and distilled to remove the solvent. The residue was treated with ethanol, followed by recrystallization from ethanol to give 1.3 g of the desired compound of the formula (VI) having a melting point of 94.5° to 97.0° C.

EXAMPLE 1

3-Dibutylamino-6-methyl-7-anilinofluoran in an amount of 30 g and 70 g of water containing 1.5 g of polyvinyl alcohol were dispersed using a paint conditioner. Another dispersion was prepared by dispersing 40 g of 2,2-bis(4-hydroxyphenyl)propane and 62 g of water containing 2 g of polyvinyl alcohol. Further, 50 g of the compound of the formula (II) and 120 g of water containing 2.5 g of polyvinyl alcohol were dispersed similarly.

After mixing the above-mentioned three dispersions, 75 g of a 40% dispersion of calcium carbonate, was added thereto, followed by addition of 25 g of a 40% dispersion of zinc stearate, 160 g of a 10% polyvinyl alcohol aqueous solution and 170 g of water with sufficient stirring to give a coating liquid.

A support was prepared by coating a mixture of 100 g of calcined kaolin and 200 g of a 10% polyvinyl alcohol aqueous solution on paper having a basis weight of 42 g/m$^2$ so as to make the coating amount 5 g/m$^2$ on dry basis, followed by drying.

On this support, the above-mentioned coating liquid was coated in an amount of 0.6 g/m$^2$ (on dry basis) and dried, followed by a super calendar treatment to give a heat-sensitive recording material.

EXAMPLE 2

The process of Example 1 was repeated except for using 50 g of the compound (III) in place of the compound (II) to give a heat-sensitive recording material.

EXAMPLE 3

The process of Example 1 was repeated except for using 50 g of the compound (IV) in place of the compound (II) to give a heat-sensitive recording material.

EXAMPLE 4

The process of Example 1 was repeated except for using 50 g of the compound (V) in place of the compound (II) to give a heat-sensitive recording material.

COMPARATIVE EXAMPLE 1

The process of Example 1 was repeated except for not using the dispersion of the compound (II) to give a heat-sensitive recording material.

EVALUATION

The heat-sensitive recording materials obtained in Examples 1 to 4 and Comparative Example 1 were subjected to measurement of image densities using a GIII FAX test machine (TH-PMD, a trade name, mfd. by Okura Denki K.K.) using a head having a dot density of 8 dots/mm$^2$, a head resistance of 185 Ω. The printing was conducted at a head voltage of 11 V and a current passing time of 0.6 ms. Image densities were measured by using a Macbeth RD-514 densitometer.

The results are shown in the following Table.

TABLE

| Example No. | Optical density |
|---|---|
| Example 1 | 0.99 |
| Example 2 | 0.93 |
| Example 3 | 0.86 |
| Example 4 | 1.15 |
| Comparative Example 1 | 0.31 |

As mentioned above, by using the special sensitizers, there can be obtained highly sensitive heat-sensitive recording materials excellent in thermal response properties.

What is claimed is:

1. A heat-sensitive recording material comprising a support and formed on the support a heat-sensitive recording layer comprising a colorless or light-colored dye precursor, a color developer capable of developing a color of said dye precursor with heating, and a sensitizer, said sensitizer being a compound of the formula:

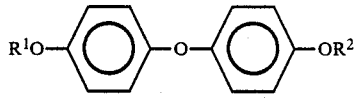

wherein $R^1$ is a lower alkyl group, a lower alkenyl group or an acyl group; and $R^2$ is an aralkyl group or an aroyl group.

2. A heat-sensitive recording material according to claim 1, wherein the sensitizer is a compound of the formula:

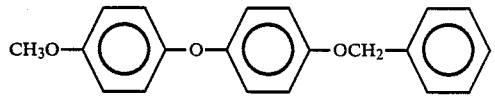

3. A heat-sensitive recording material according to claim 1, wherein the sensitizer is a compound of the formula:

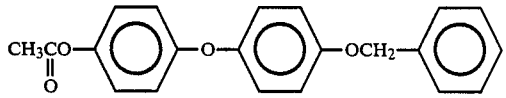

4. A heat-sensitive recording material according to claim 1, wherein the sensitizer is a compound of the formula:

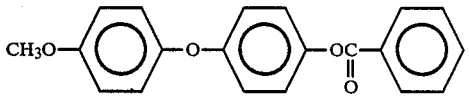

5. A heat-sensitive recording material according to claim 1, wherein the sensitizer is a compound of the formula:

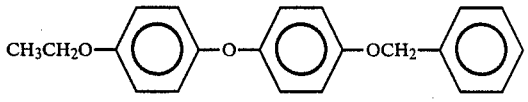

6. A heat-sensitive recording material according to claim 1, wherein the sensitizer is a compound of the formula:

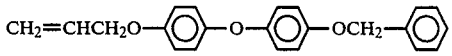

* * * * *